US006157117A

United States Patent [19]

Taylor

[11] Patent Number: 6,157,117

[45] Date of Patent: Dec. 5, 2000

[54] TUBE LAMP

[76] Inventor: Douglas Taylor, 11 Madder Lake Cir., Commack, N.Y. 11725

[21] Appl. No.: 09/093,907

[22] Filed: Jun. 8, 1998

[51] Int. Cl.[7] ..... H01J 5/48

[52] U.S. Cl. ..... 313/318.01; 313/318.02; 313/318.11

[58] Field of Search ..... 313/318.01, 318.02, 313/318.11

[56] References Cited

U.S. PATENT DOCUMENTS

| | | | |
|---|---|---|---|
| 4,559,480 | 12/1985 | Nobs | 315/324 |
| 4,831,505 | 5/1989 | Van Norman | 362/216 |
| 4,999,755 | 3/1991 | Lin | 362/250 |
| 5,113,329 | 5/1992 | Lin | 362/238 |
| 5,628,557 | 5/1997 | Huang | 362/252 |

*Primary Examiner*—Vip Patel

[57] ABSTRACT

A first tube lamp (110) comprises a tube light (12) which comprises a transparent or translucent tube light housing (12A) having a tube light bulb male end (12M) securely attached at one distal end and a tube light bulb female end (12F) securely attached at an opposite distal end. The tube light housing (12A) is hollow or is filled. The tube light (12) further comprises at least one tube light bulb (12B) each having a tube light bulb positive lead (12BA) and a tube light bulb negative lead (12BB) contained within the tube light housing (12A). The tube light (12) further comprises a tube light shroud (12C) longitudinally disposed thereon. The tube light shroud (12C) functions as an insulating means to protect the first holder (114) from heat produced by the tube light (12).

18 Claims, 10 Drawing Sheets

TUBE LAMP

BACKGROUND OF THE INVENTION

1. Field of the Invention

The present invention relates to lighting fixtures. More particularly, the present invention relates to tube lightening bulbs and holding devices.

2. Description of the Prior Art

Tube lighting produces a soft light which is used for subdued lighting of areas or accent lighting. Tube lighting typically is manufactured in long continuous lengths. The characteristics of tube lighting lend it to be used for accent lighting along shelving and cabinets where it is desired to display contents with a soft light. Long continuous lengths are not readily adaptable to short confined areas such as shelving. What is needed is a tube light which is available in preselected lengths which cooperate with the standard dimensions of the interior of shelves and cabinets. Further, it is desirable to have tube lighting which is adapted to turn corners without a large unsightly connector. It is also desired to have a tube light bulb which is replaceable without removing the cord with the lamp.

In U.S. Pat. No. 5,628,557, titled Assembly Tube Light for Window Display, invented by Peter K. L. Huang, an n assembly tube light including at least two tube lights and at least one connector for connecting each two tube lights either in line or at right angles, each tube light having a first conductor, a second conductor, a plurality of bulbs respectively connected between the first conductor and the second conductor, and two coupling units at two opposite ends, each coupling unit including two diagonal pairs of plug holes arranged in a square and respectively connected to the first conductor and the second conductor, each connector having two pairs of parallel contact pins arranged in a square corresponding to the plug holes of each coupling unit for inserting into two plug hole on a first tube light and two plug hole on a second tube light for permitting them to be fastened together and electrically connected in series, the two contact pins of the same pair being electrically connected together.

In U.S. Pat. No. 5,113,329, titled Tube Light, invented by Tak-Huei Lin, a tube light comprises a tube having a continuous length, a plurality of light units adapted to be secured on the tube, and a fastener for securing the light units on the tube. Each light unit comprises a socket portion of which the upper part is formed with a column having an external thread, and the column can just pass through a perforation provided on the top surface of the tube. Thereafter, the light unit can be secured on the tube by the fastener such that the external thread of the column is engaged with the internal thread of the fastener. Contacts extend from inside of the socket portion of the tube and lay on the upper surface of the socket portion so as to press against conductor strips which extend continuously underneath the top surface of the tube and can be connected with an electrical power source. The bottom of the tube is open, and after the light units are mounted on the tube, the bottom of the tube can be enclosed by a lid having a dimension conforming with the length and width of the tube.

In U.S. Pat. No. 4,999,755, titled Tube Light, invented by Tak-Huei Lin, a tube light comprises a tube having a continuous length, and a plurality of light units which conform to the inner configuration of the tube and can suitably be positioned anywhere in the tube. Conductor strips which are adapted to be connected with a power supply are disposed in parallel in the tube whereby the bulbs of the light units are engaged by contacting of the conductor strips with the contacts of the light units. The light tube is simple in structure and can be loaded with a suitable number of the light units in optional locations. In addition, the structure of the tube light is adapted for mass production. Further, the structure of the tube light may have a cover or clips, or be provided with wings on the light units, to facilitate securing the light units in the tube.

In U.S. Pat. No. 4,831,505, titled Circular Flourescent Tube Light Fixture for Ceiling Fan, invented by Kenneth M. Van Norman, a circular flourescent tube light fixture for a ceiling fan, particularly one suspended from a low ceiling The light holder is adjustable upward when a deep concave light reflector is used and is adjustable downward when a flat light shield is used. The holder fits around a tubular housing that mounts on the lower center end of the ceiling fan mechanism. Within this housing is the transformer, starter, and wiring that extends between the ceiling fan motor and the flourescent tube light. A friction spring fits between the light holder and tubular housing to retain the holder in upward position when a deep concave light reflector is used. It also prevents rotation of the holder relative to the housing as an electrical safety measure since electrical wiring extends between them. In one embodiment the light reflector is fastened to the base of the tubular housing and in another it is attached to the holder and moves vertically with the tube light.

In U.S. Pat. No. 4,559,480, titled Color Matrix Display with Discharge Tube Light Emitting elements, invented by Erwin Nobs, a a pixel a plurality of which when arranged in rows and columns may form a matrix display board. The element comprises one or more discharge tubes (10, 11, 12). For a board displaying images (textual or video) in color the internal wall of each tube is coated with a fluorescent substance which responds respectively to the red, green and blue portions of the spectrum. By independently varying the intensity of the light emitted by each tube light is obtained at the element output the resultant wavelength of which may extend over the entire visible spectrum. The invention finds use in a display board employed to convey information to crowds of people as for example in a sports stadium.

Numerous innovations for a first tube lamp have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a tube lamp which has a focusing lens formed as an integral part of the assembly. The tube lamp material may be clear or tinted. A plurality of low wattage miniature or sub-miniature lamps are contained within the tube. The lamps may be wired in a series, parallel or a combination circuit. The circuit of lamps terminate on both ends in a connector. One end of the lamp has a male connector the other has a female connector. The two lamps may be joined together by connecting one to another at the mating ends. The lamps are chosen so that a separate transformer is not required. Because the power cord is plugged into the lamp end, replacement of the lamp does not require removal of the power cord from the installation. This simplifies the maintenance of the lamp fixtures. The length of the tube lamps are preselected to conform to the standard lengths of cabinets and shelving so that one or a combination of lamps can be adapted to accommodate most standard length applications. The tube lamp has a reflector into which the lamp snaps. The reflector is also the mounting device which is attached to a surface by a fastening means.

The types of problems encountered in the prior art are selecting lighting which provides a pleasing cosmetic effect.

In the prior art, unsuccessful attempts to solve this problem were attempted namely: tube lights which are available in long lengths and have the power cord permanently attached. However, the problem was solved by the present invention because the tube lamps come in preselected length which are extendable by joining one lamp to another.

The present invention went contrary to the teaching of the art by separately attaching the power cord so that replacement of the lamp does not require removal of the power cord from the installation.

The present invention solved a long felt need for tube lighting which is adaptable to the interior dimensions of standard shelving.

The inventor of the present invention experienced a great deal of commercial success with a tube light lamp having a power cord fixedly attached at one end.

Accordingly, it is an object of the present invention to provide a tube light having a housing.

More particularly, it is an object of the present invention to provide a housing having a tube light shroud.

In keeping with these objects, and with others which will become apparent hereinafter, one feature of the present invention resides, briefly stated, in a pair of mating connectors are positioned at opposite ends of the housing functioning to permit sizing the lighting to fit a variety of installations.

When the first tube lamp is designed in accordance with the present invention, an easily replaceable and adaptable lighting fixture results.

In accordance with another feature of the present invention, a first holder provides for mounting the tube lamp. The first holder may be fastened by tape, screws and hook & loop.

Another feature of the present invention is that the first holder comprises a reflector functioning to direct the light from the tube lamp to a preselected area.

Yet another feature of the present invention is that the construction of the tube light bulb positive lead and the tube light bulb negative lead permit the assembly to be UL rated.

Still another feature of the present invention is that the tube light bulb male end and tube light bulb female end are not polarized.

Yet still another feature of the present invention is that a first holder base is flat permitting attachment to interior surfaces of shelving.

Still yet another feature of the present invention is that the second holder contains a tube light.

Another feature of the present invention is that the second holder adaptor is snappably retained within a second holder adaptor cavity.

Yet another feature of the present invention is that a second holder left clip flair and a second holder right clip flair function to separate the second holder left clip and a second holder right clip as the second holder adaptor is inserted into the second holder cavity.

Still another feature of the present invention is that a second holder base is securely attached to a second holder left clip and a second holder right clip at a lower edge.

Yet still another feature of the present invention is that a second holder base comprises a second holder base opening functioning to retain a fastener therein.

Still yet another feature of the present invention is that the second holder left clip and a second holder right clip are formed of a resilient material.

Another feature of the present invention is that the second holder adaptor is formed of resilient material.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

Common Components

12—tube light (12)
12A—tube light housing (12A)
12B—tube light bulb (12B)
12C—tube light shroud (12C)
12BA—tube light bulb positive lead (12BA)
12BB—tube light bulb negative lead (12BB)
12M—tube light bulb male end (12M)
12MA—tube light bulb male end first connector (12MA)
12MB—tube light bulb male end second connector (12MB)
12F—tube light bulb female end (12F)
12FA—tube light bulb female end first connector (12FA)
12FB—tube light bulb female end second connector (12FB)

First Embodiment

110—first tube lamp (110)
114—first holder (114)
114R—first holder right reflector (114R)
114L—first holder left reflector (114L)
114B—first holder base (114B)
114BA—first holder base opening (114BA)
114C—first holder cavity (114C)

Second Embodiment

210—second tube lamp (210)
214—second holder (214)
214A—second holder adaptor (214A)
214AC—second holder adaptor cavity (214AC)
214L—second holder left clip (214L)
214LA—second holder left clip flair (214LA)
214R—second holder right clip (214R)
214RA—second holder right clip flair (214RA)
214B—second holder base (214B)
214BA—second holder base opening (214BA)
214C—second holder cavity (214C)

Third Embodiment

310—third tube lamp (310)
314F—third holder front adaptor (314F)
314FR—third holder front adaptor right reflector (314FR)
314FL—third holder front adaptor left reflector (314FL)
314FB—third holder front adaptor base (314FB)
314FC—third holder front adaptor cavity (314FC)
314R—third holder rear adaptor (314R)
314RR—third holder rear adaptor right reflector (314RR)
314RL—third holder rear adaptor left reflector (314RL)
314RB—third holder rear adaptor base (314RFB)
314RC—third holder rear adaptor cavity (314RC)
314C—third holder middle (314C)
314CR—third holder middle adaptor right reflector (314CR)
314CL—third holder middle adaptor left reflector (314CL)
314CC—third holder middle adaptor cavity (314CC)

DESCRIPTION OF THE PREFERRED EMBODIMENT

Figure 1:
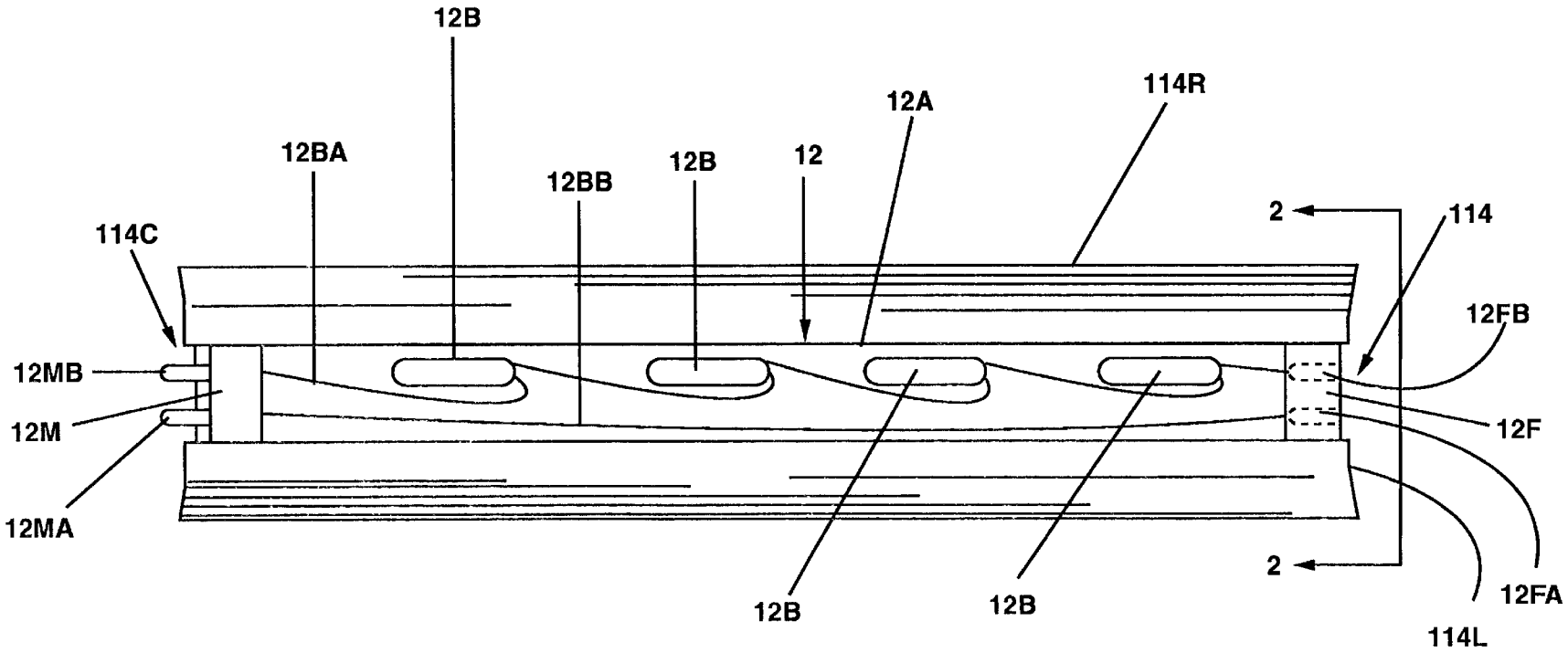
FIG. 1 is a side view of a first tube lamp.

Firstly referring to FIG. 1 which is a side view of a first tube lamp (110). The first tube lamp (110) comprises a tube light (12) which comprises a transparent or translucent tube light housing (12A) having a tube light bulb male end (12M) securely attached at one distal end and a tube light bulb female end (12F) securely attached at an opposite distal end. The tube light housing (12A) is hollow or is filled. The tube light (12) further comprises at least one tube light bulb (12B) each having a tube light bulb positive lead (12BA) and a tube light bulb negative lead (12BB) contained within the tube light housing (12A). The tube light (12) further comprises a tube light shroud (12C) longitudinally disposed thereon. The tube light shroud (12C) functions as an insulating means to protect the first holder (114) from heat produced by the tube light (12).

The tube light bulb male end (12M) comprises a tube light bulb male end first connector (12MA) electrically connected to a distal end of the tube light bulb positive lead (12BA). The tube light bulb male end (12M) further comprises a tube light bulb male end second connector (12MB) electrically connected to a distal end of the tube light bulb positive lead (12BA). The tube light bulb female end (12F) comprises a tube light bulb female end first connector (12FA) electrically connected to an opposite distal end of the tube light bulb positive lead (12BA). The tube light bulb female end (12F) further comprises a tube light bulb female end second connector (12FB) which is electrically connected to an opposite distal end of the tube light bulb male end second connector (12MB).

The first tube lamp (110) further comprises an elongated first holder (114) which comprises a first holder right reflector (114R). The first holder right reflector (114R) is securely connected along a bottom edge to a right edge of a first holder base (114B). The first holder base (114B) further comprises at least one first holder base opening (114BA) therethrough within which a fastener is positioned. The elongated first holder (114) further comprises a first holder left reflector (114L) which is securely connected along a bottom edge to a left edge of a first holder base (114B) forming a first holder cavity (114C) therebetween wherein the tube light (12) is positioned.

The tube light housing (12A) is manufactured from a material selected from a group consisting of plastic, plastic composite, glass, glass composite, rubber and rubber composite.

The first holder (114) is manufactured from a material selected from a group consisting of plastic, plastic composite, metal, metal alloy, wood, wood composite rubber and rubber composite.

The first holder (114) is manufactured from a resilient material.

Figure 2:
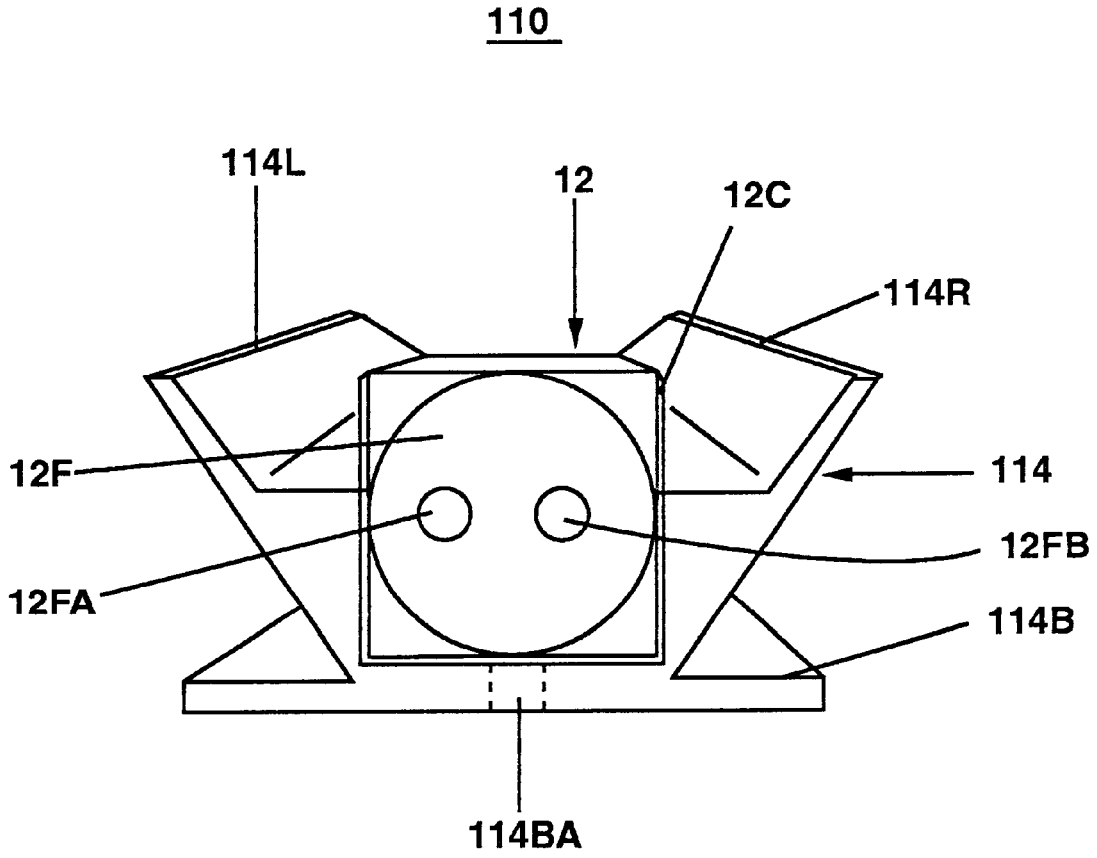
FIG. 2 is an end view of a first tube lamp showing a tube light bulb female end.

Secondly, referring to FIG. 2 which is an end view of a first tube lamp (110) showing a tube light bulb female end (12F). The tube light bulb female end (12F) comprises a tube light bulb female end first connector (12FA) electrically connected to an opposite distal end of the tube light bulb positive lead (12BA). The tube light bulb female end (12F) further comprises a tube light bulb female end second connector (12FB) which is electrically connected to an opposite distal end of the tube light bulb male end second connector (12MB).

A first tube lamp (110) comprises a tube light (12). The tube light (12) further comprises a tube light shroud (12C) longitudinally disposed thereon. The tube light shroud (12C) functions as an insulating means to protect the first holder (114) from heat produced by the tube light (12).

The first tube lamp (110) further comprises an elongated first holder (114) which comprises a first holder right reflector (114R). The first holder right reflector (114R) is securely connected along a bottom edge to a right edge of a first holder base (114B). The first holder base (114B) further comprises at least one first holder base opening (114BA) therethrough within which a fastener is positioned. The elongated first holder (114) further comprises a first holder left reflector (114L) which is securely connected along a bottom edge to a left edge of a first holder base (114B) forming a first holder cavity (114C) therebetween wherein the tube light (12) is positioned.

Figure 3:
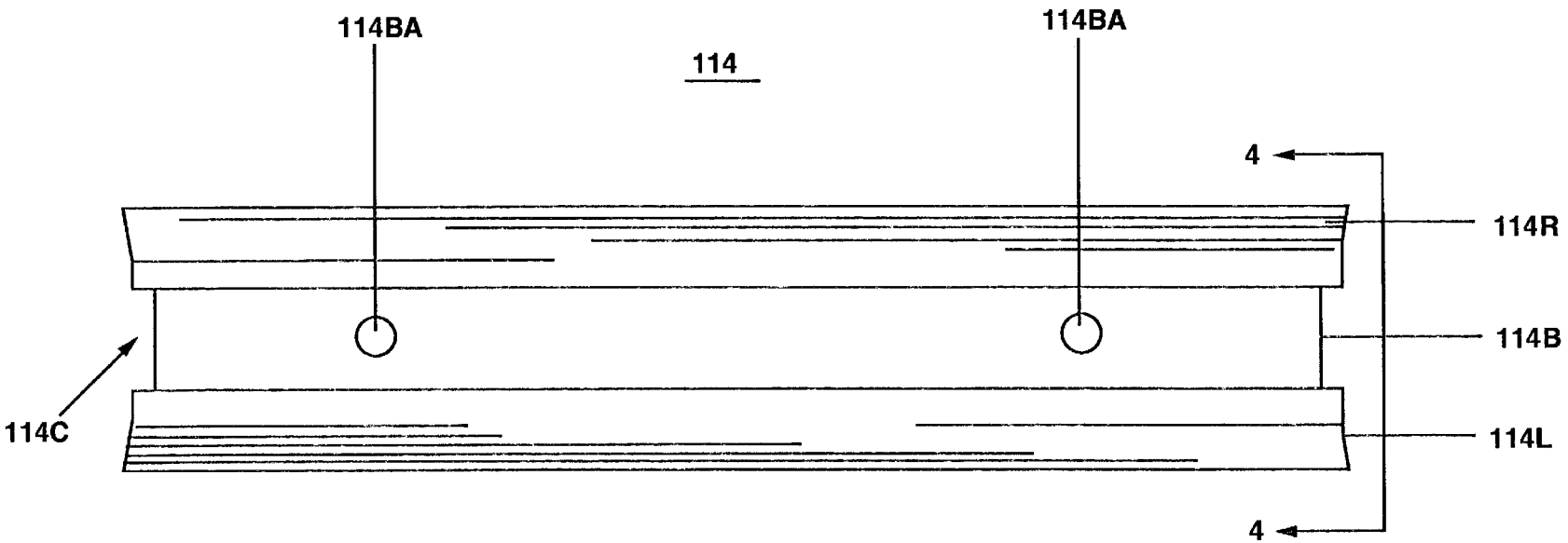
FIG. 3 is a top view of a first holder.

Next, referring to FIG. 3 which is a top view of a first holder (114). The first tube lamp (110) comprises an elongated first holder (114) which comprises a first holder right reflector (114R). The first holder right reflector (114R) is securely connected along a bottom edge to a right edge of a first holder base (114B). The first holder base (114B) further comprises at least one first holder base opening (114BA) therethrough within which a fastener is positioned. The elongated first holder (114) further comprises a first holder left reflector (114L) which is securely connected along a bottom edge to a left edge of a first holder base (114B) forming a first holder cavity (114C) therebetween wherein the tube light (12) is positioned.

Figure 4:
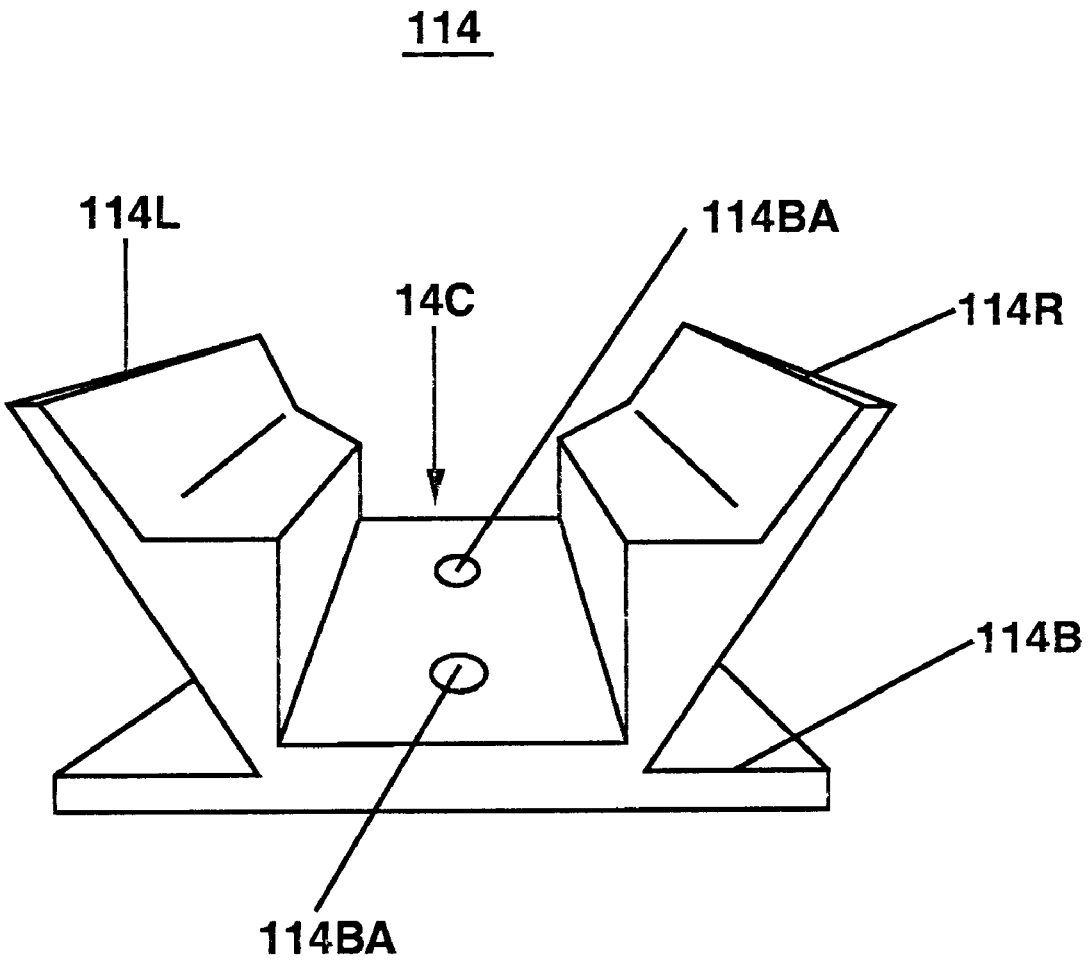
FIG. 4 is a perspective end view of a first holder.

Next, referring to FIG. 4 which is a perspective end view of a first holder (114). The elongated first holder (114) comprises a first holder right reflector (114R). The first holder right reflector (114R) is securely connected along a bottom edge to a right edge of a first holder base (114B). The first holder base (114B) further comprises at least one first holder base opening (114BA) therethrough within which a fastener is positioned. The elongated first holder (114) further comprises a first holder left reflector (114L) which is securely connected along a bottom edge to a left edge of a first holder base (114B) forming a first holder cavity (114C) therebetween.

Figure 5:
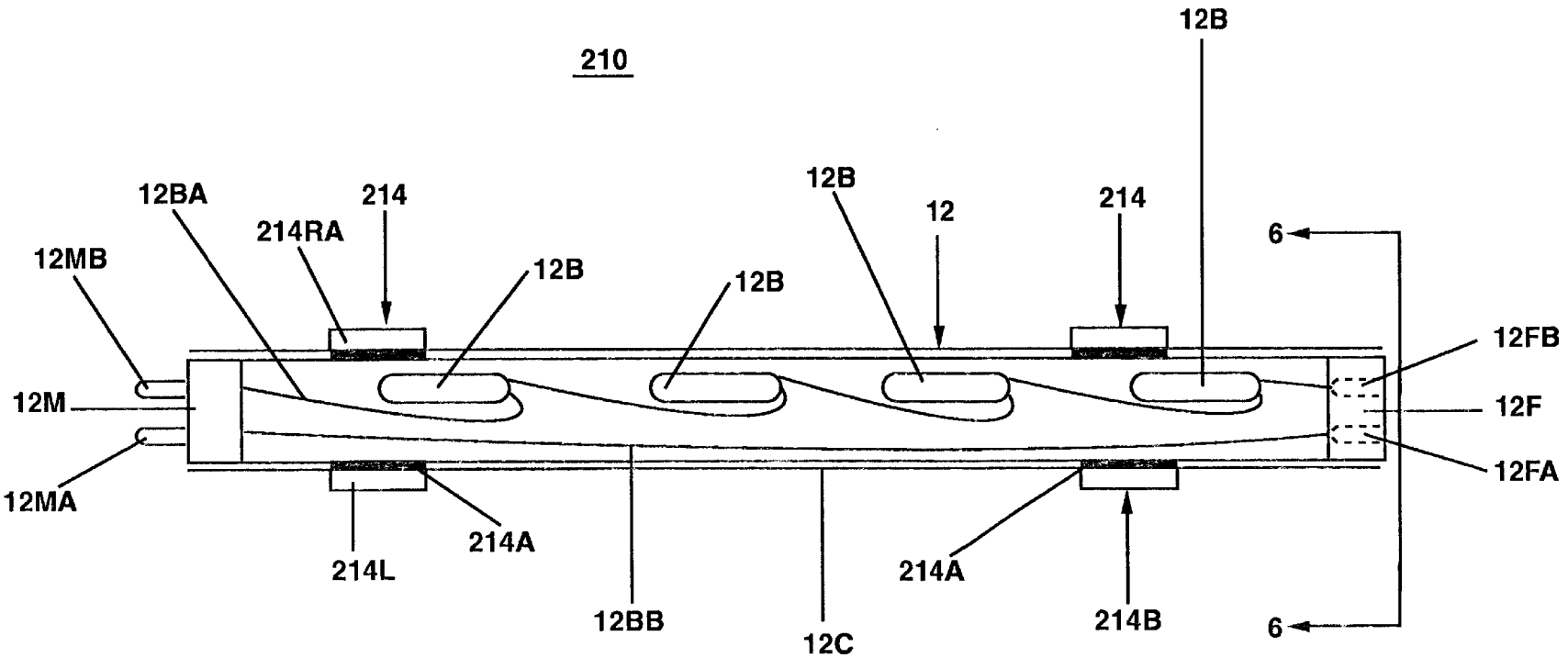
FIG. 5 is a top view of a second holder containing a tube light.

Next, referring to FIG. 5 which is a top view of a second tube lamp (210) having a second holder (214) containing the tube light (12). The second tube lamp (210) comprises a tube light (12) which comprises a transparent or translucent tube light housing (12A) having a tube light bulb male end (12M) securely attached at one distal end and a tube light bulb female end (12F) securely attached at an opposite distal end. The tube light housing (12A) is hollow or filled.

The tube light (12) further comprises at least one tube light bulb (12B) each having a tube light bulb positive lead (12BA) and a tube light bulb negative lead (12BB) contained within the tube light housing (12A). The tube light bulb male end (12M) comprises a tube light bulb male end first connector (12MA) electrically connected to a distal end of the tube light bulb positive lead (12BA). The tube light bulb male end (12M) further comprises a tube light bulb male end second connector (12MB) electrically connected to a distal end of the tube light bulb positive lead (12BA).

The tube light bulb female end (12F) comprises a tube light bulb female end first connector (12FA) electrically connected to an opposite distal end of the tube light bulb positive lead (12BA). The tube light bulb female end (12F) further comprises a tube light bulb female end second connector (12FB) electrically connected to an opposite distal end of the tube light bulb male end second connector (12MB).

The tube light (12) further comprises a tube light shroud (12C) longitudinally disposed thereon. The tube light shroud (12C) functions as an insulating means to protect the second holder (214) from heat produced by the tube light (12).

The second tube lamp (210) further comprises a second holder (214) which comprises a second holder adaptor (214A) having a second holder adaptor cavity (214AA) therein, within which the tube light (12) is positioned. The second holder (214) further comprises a second holder right clip (214R) securely connected along a bottom edge to a right edge of a second holder base (214B). The elongated second holder (214) further comprises a second holder left clip (214L) securely connected along a bottom edge to a left edge of a second holder base (214B) forming a second holder cavity (214C) therebetween wherein the second holder adaptor (214A) is positioned. The second holder base (214B) further comprises at least one second holder base opening (214BA) therethrough within which a fastener is positioned. The second holder base (214B) further comprises at least one second holder base opening (214BA) therethrough within which a fastener is positioned.

The second holder left clip (214L) comprises an outwardly angled second holder left clip flair (214LA). The second holder right clip (214R) further comprises an outwardly angled second holder right clip flair (214RA). The second holder left clip flair (214LA) and the second holder right clip flair (214RA) function to facilitate positioning the second holder adaptor (214A) within the second holder cavity (214C).

The tube light housing (12A) is manufactured from a material selected from a group consisting of plastic, plastic composite, glass, glass composite, rubber and rubber composite.

The second holder (214) is manufactured from a material selected from a group consisting of plastic, plastic composite, metal, metal alloy, wood, wood composite rubber and rubber composite.

Figure 6:
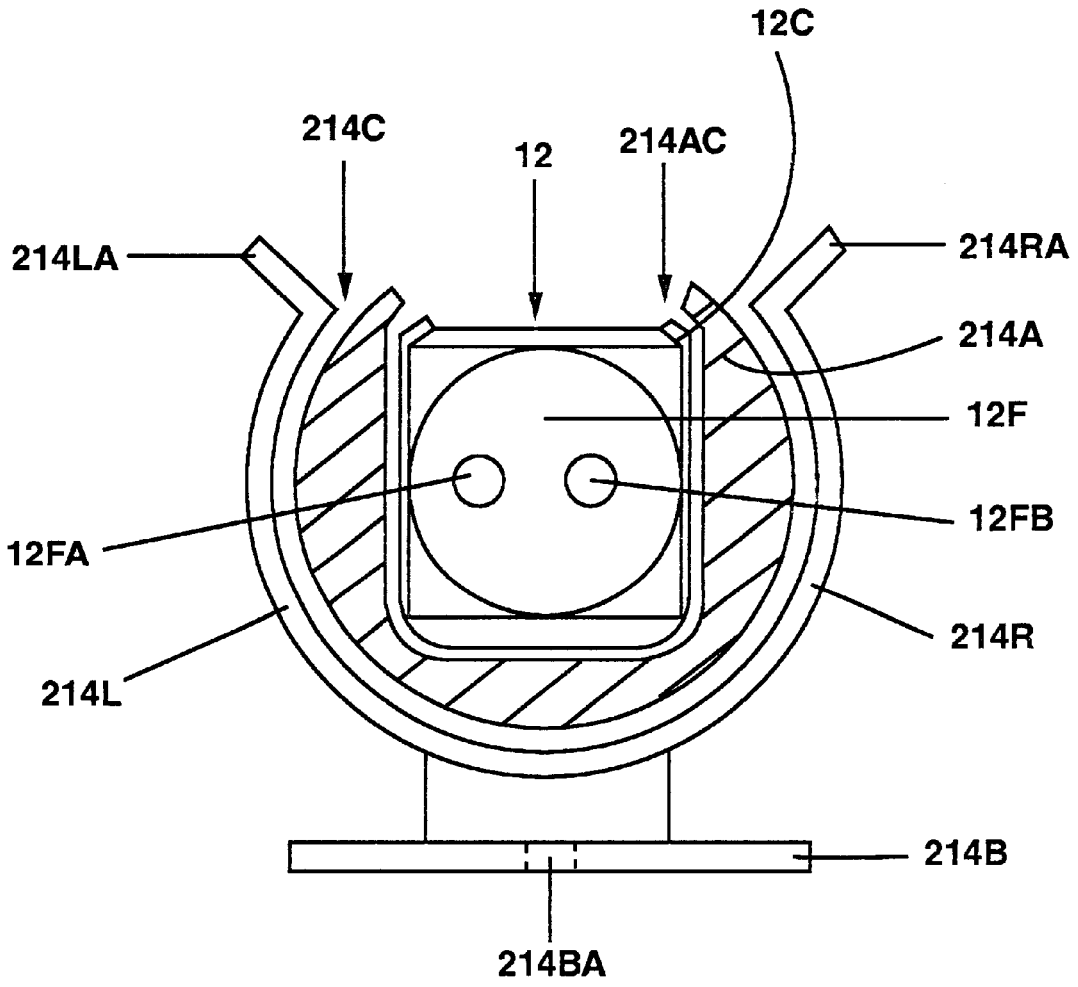
FIG. 6 is a end view of a second holder containing a tube light.
Figure 7:
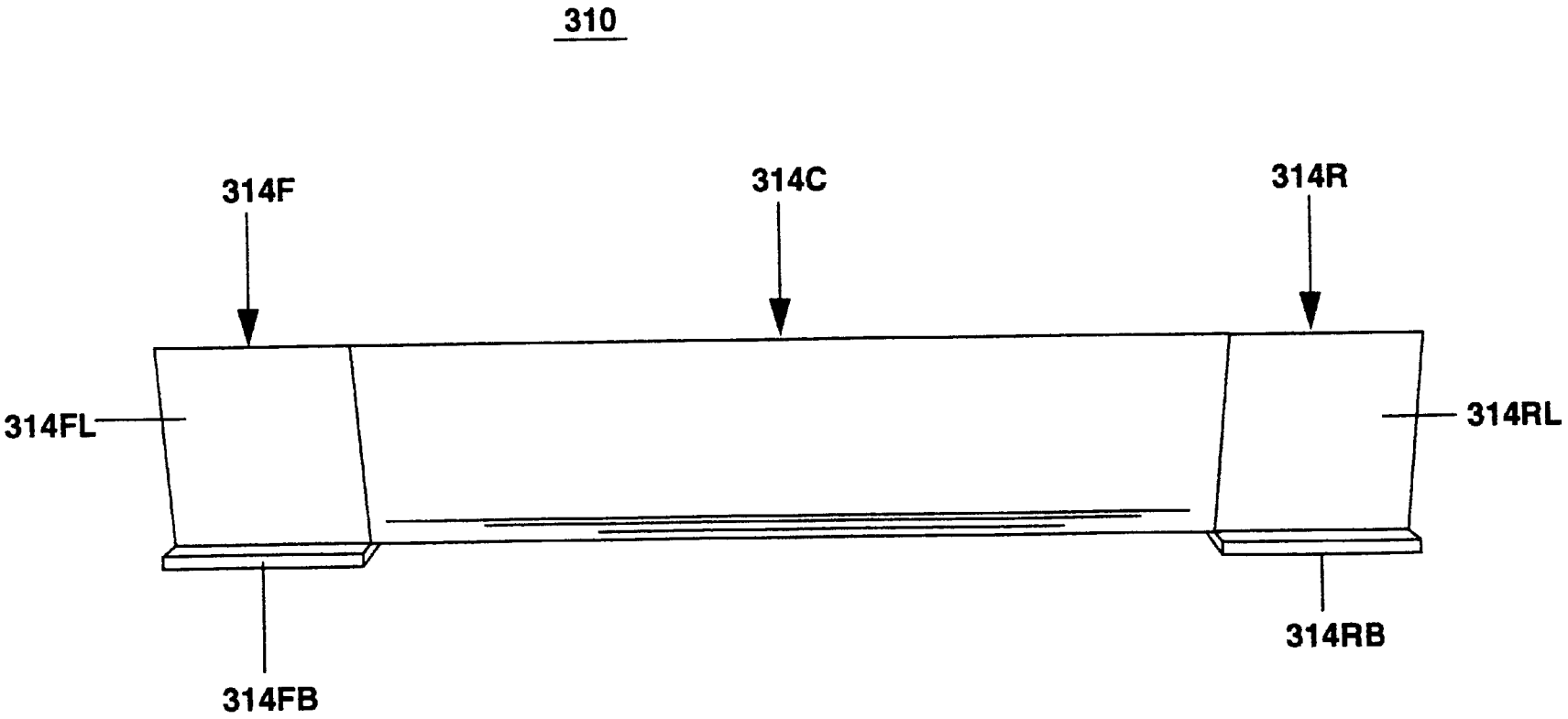
FIG. 7 is a side view of a third tube lamp.
Figure 8:
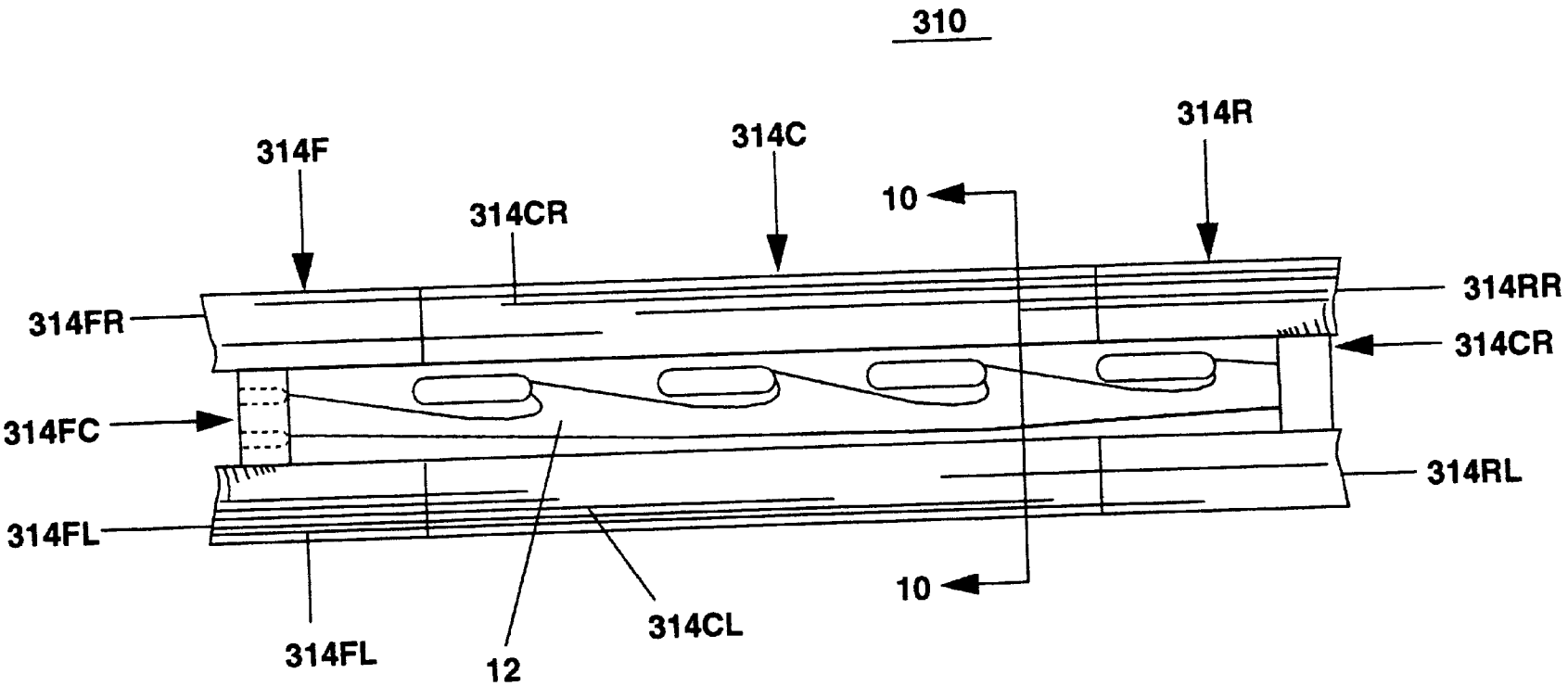
FIG. 8 is a top view of a third tube lamp.
Figure 9:
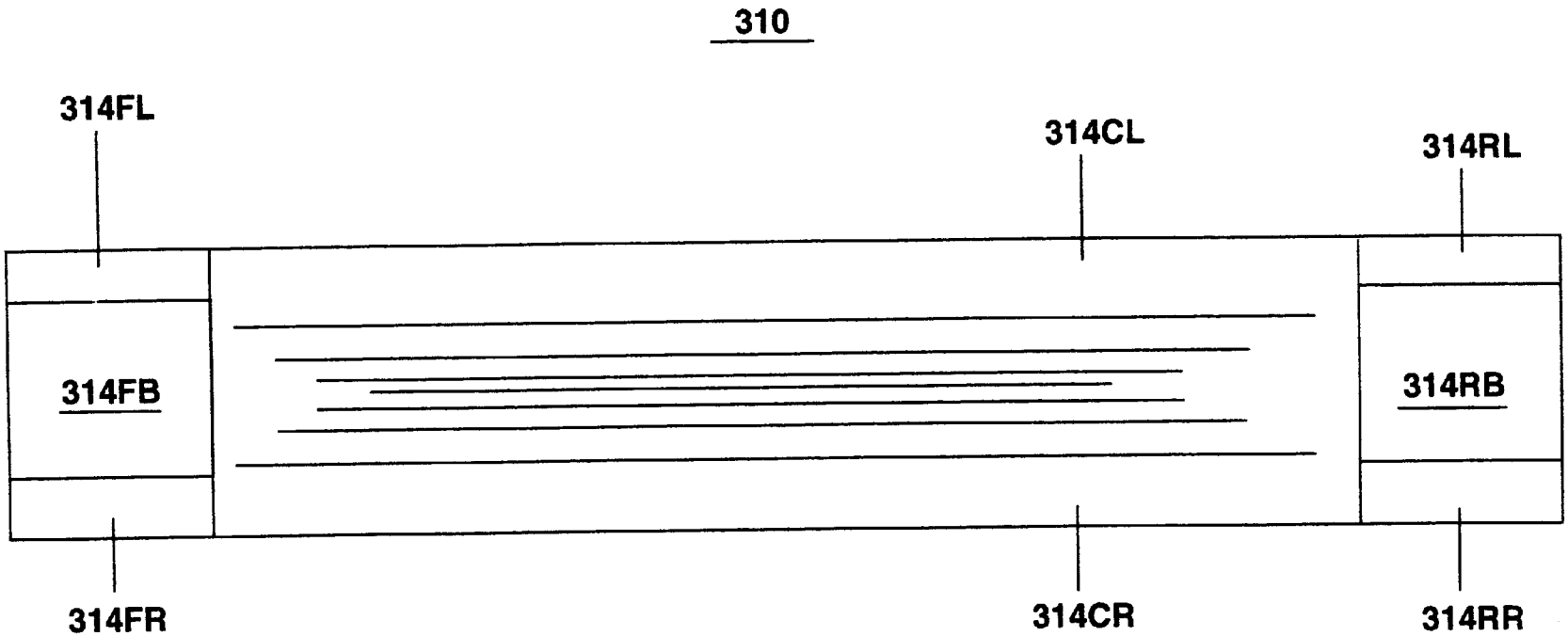
FIG. 9 is a bottom view of a third tube lamp.
Figure 10:
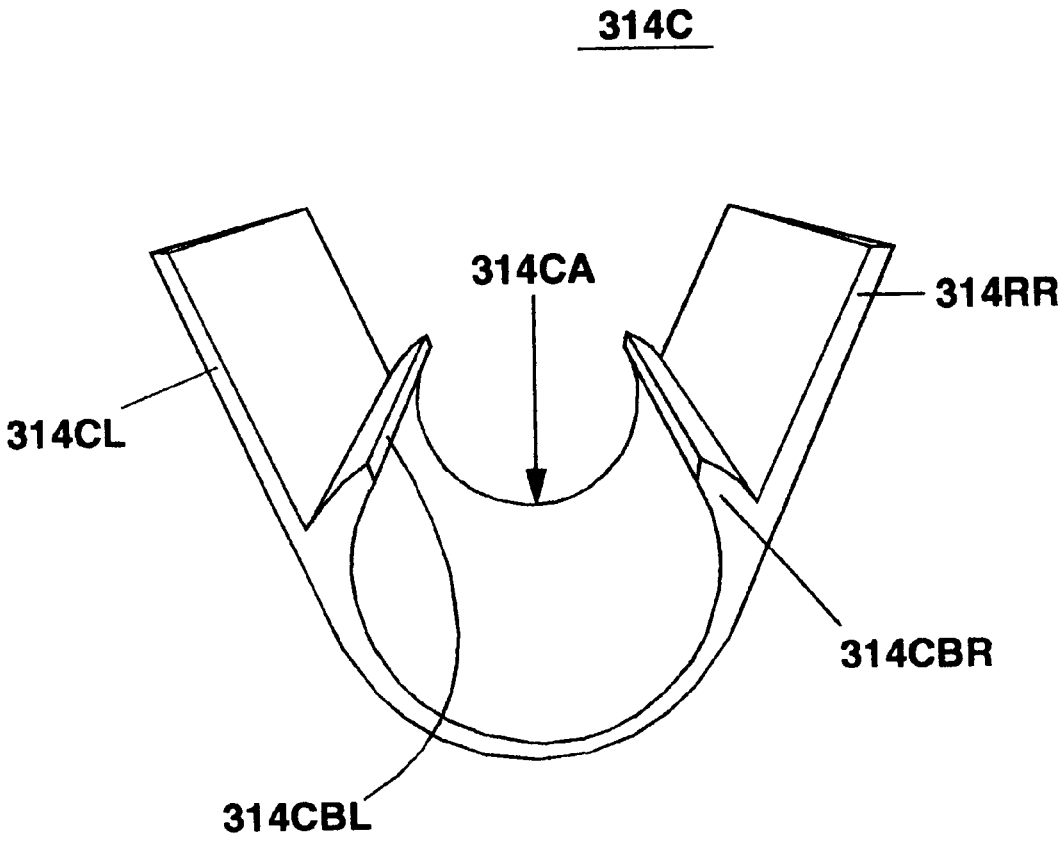
FIG. 10 is a cross-sectional view of a third tube lamp along line 10—10 of FIG. 8.

Finally, referring to FIG. 6 which is an end view of a second tube lamp (210) showing a tube light bulb female end (12F). The tube light bulb female end (12F) is securely attached at an opposite distal end of the tube light (12).

The tube light bulb female end (12F) comprises a tube light bulb female end first connector (12FA) electrically connected to an opposite distal end of the tube light bulb positive lead (12BA). The tube light bulb female end (12F) further comprises a tube light bulb female end second connector (12FB) electrically connected to an opposite distal end of the tube light bulb male end second connector (12MB).

The second tube lamp (210) further comprises a second holder (214) which comprises a second holder adaptor (214A) having a second holder adaptor cavity therein (214AA) within which the tube light (12) is positioned. The second holder (214) further comprises a second holder right clip (214R) securely connected along a bottom edge to a right edge of a second holder base (214B). The elongated second holder (214) further comprises a second holder left clip (214L) securely connected along a bottom edge to a left edge of a second holder base (214B) forming a second holder cavity (214C) therebetween wherein the second holder adaptor (214A) is positioned. The second holder base (214B) further comprises at least one second holder base opening (214BA) therethrough within which a fastener is positioned. The second holder base (214B) further comprises at least one second holder base opening (214BA) therethrough within which a fastener is positioned.

The second holder left clip (214L) comprises an outwardly angled second holder left clip flair (214LA). The second holder right clip (214R) further comprises an outwardly angled second holder right clip flair (214RA). The second holder left clip flair (214LA) and the second holder right clip flair (214RA) function to facilitate positioning the second holder adaptor (214A) within the second holder cavity (214C).

The second holder (214) is manufactured from a material selected from a group consisting of plastic, plastic composite, metal, metal alloy, wood, wood composite rubber and rubber composite.

It will be understood that each of the elements described above, or two or more together, may also find a useful application in other types of constructions differing from the type described above.

Lastly referring to FIGS. 7, 8, 9, and 10 which are side, top, bottom, and cross-sectional views of a third tube lamp (310) having a third holder front adaptor (314F) which comprises a third holder front adaptor right reflector (314FR) and a third holder front adaptor left reflector (314FL) forming a third holder front adaptor cavity (314FC) therebetween removably engaging a tube light (12) therein. The third holder front adaptor (314F) having a third holder front adaptor base (314FB) functioning as a stable mount to attach to a surface.

The third tube lamp (310) further has a third holder rear adaptor (314R) which comprises a third holder rear adaptor right reflector (314RR) and a third holder rear adaptor left reflector (314RL) forming a third holder rear adaptor cavity (314RC) therebetween removably engaging the tube light (12) therein. The third holder rear adaptor (314R) having a third holder rear adaptor base (314RB) functioning as a satble mount to attach to a surface.

The third tube lamp (310) further has a third holder middle adaptor (314C) which comprises a third holder middle adaptor right reflector (314CR) and a third holder middle adaptor left reflector (314CL) forming a third holder middle adaptor cavity (314CC) therebetween rotatably engaging the tube light (12) therein.

The third holder front adaptor (314F) and the third holder rear adaptor (314R) and the third holder middle (314C) are manufactured from a material selected from a group consisting of plastic, plastic composite, glass, glass composite, rubber, rubber composite, metal, metal alloy, wood, and wood composite.

The third holder front adaptor cavity (314FC) and the third holder rear adaptor cavity (314RC) are optionally closed comprising a covering thereover.

While the invention has been illustrated and described as embodied in a tube light holder, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A first tube lamp (110) comprising:

A) a tube light (12) which comprises a transparent or translucent tube light housing (12A) having a tube light bulb male end (12M) securely attached at one distal end and a tube light bulb female end (12F) securely attached at an opposite distal end, the tube light (12) further comprises at least one tube light bulb (12B) each having a tube light bulb positive lead (12BA) and a tube light bulb negative lead (12BB) contained within the tube light housing (12A), the tube light bulb male end (12M) comprises a tube light bulb male end first connector (12MA) electrically connected to a distal end of the tube light bulb positive lead (12BA), the tube light bulb male end (12M) further comprises a tube light bulb male end second connector (12MB) electrically connected to a distal end of the tube light bulb positive lead (12BA), the tube light bulb female end (12F) comprises a tube light bulb female end first connector (12FA) electrically connected to an opposite distal end of the tube light bulb positive lead (12BA), the tube light bulb female end (12F) further comprises a tube light bulb female end second connector (12FB) electrically connected to an opposite distal end of the tube light bulb male end second connector (12MB);

B) an elongated first holder (114) which comprises a first holder right reflector (114R) securely connected along a bottom edge to a right edge of a first holder base (114B), the elongated first holder (114) further comprises a first holder left reflector (114L) securely connected along a bottom edge to a left edge of a first holder base (114B) forming a first holder cavity (114C) therebetween wherein the tube light (12) is positioned.

2. The first tube lamp (110) as described in claim 1, wherein the tube light housing (12A) is hollow.

3. The first tube lamp (110) as described in claim 1, wherein the tube light housing (12A) is filled.

4. The first tube lamp (110) as described in claim 1, wherein the tube light (12) further comprises a tube light shroud (12C) longitudinally disposed thereon, the tube light shroud (12C) functions as an insulating means to protect the first holder (114) from heat produced by the tube light (12).

5. The first tube lamp (110) as described in claim 1, wherein the first holder base (114B) further comprises at least one first holder base opening (114BA) therethrough within which a fastener is positioned.

6. The first tube lamp (110) as described in claim 1, wherein the tube light housing (12A) is manufactured from a material selected from a group consisting of plastic, plastic composite, glass, glass composite, rubber and rubber composite.

7. The first tube lamp (110) as described in claim 1, wherein the first holder (114) is manufactured from a material selected from a group consisting of plastic, plastic composite, metal, metal alloy, wood, wood composite rubber and rubber composite.

8. A second tube lamp (210) comprising:

A) a tube light (12) which comprises a transparent or translucent tube light housing (12A) having a tube light bulb male end (12M) securely attached at one distal end and a tube light bulb female end (12F) securely attached at an opposite distal end, the tube light (12) further comprises at least one tube light bulb (12B) each having a tube light bulb positive lead (12BA) and a tube light bulb negative lead (12BB) contained within the tube light housing (12A), the tube light bulb male end (12M) comprises a tube light bulb male end first connector (12MA) electrically connected to a distal end of the tube light bulb positive lead (12BA), the tube light bulb male end (12M) further comprises a tube light bulb male end second connector (12MB) electrically connected to a distal end of the tube light bulb positive lead (12BA), the tube light bulb female end (12F) comprises a tube light bulb female end first connector (12FA) electrically connected to an opposite distal end of the tube light bulb positive lead (12BA), the tube light bulb female end (12F) further comprises a tube light bulb female end second connector (12FB) electrically connected to an opposite distal end of the tube light bulb male end second connector (12MB); and B) a second holder (214) which comprises a second holder adaptor (214A) having a second holder adaptor cavity (214AA) therein within which the tube light (12) is positioned, the second holder (214) further comprises a second holder right clip (214R) securely connected along a bottom edge to a right edge of a second holder base (214B), the elongated second holder (214) further comprises a second holder left clip (214L) securely connected along a bottom edge to a left edge of a second holder base (214B) forming a second holder cavity (214C) therebetween wherein the second holder adaptor (214A) is positioned.

9. The second tube lamp (210) as described in claim 8, wherein the tube light housing (12A) is hollow.

10. The second tube lamp (210) as described in claim 8, wherein the tube light housing (12A) is filled.

11. The second tube lamp (210) as described in claim 8, wherein the tube light (12) further comprises a tube light shroud (12C) longitudinally disposed thereon, the tube light shroud (12C) functions as an insulating means to protect the second holder (214) from heat produced by the tube light (12).

12. The second tube lamp (210) as described in claim 8, wherein the second holder base (214B) further comprises at least one second holder base opening (214BA) therethrough within which a fastener is positioned.

13. The second tube lamp (210) as described in claim 8, wherein the tube light housing (12A) is manufactured from a material selected from a group consisting of plastic, plastic composite, glass, glass composite, rubber and rubber composite.

14. The second tube lamp (210) as described in claim 8, wherein the second holder (214) is manufactured from a material selected from a group consisting of plastic, plastic composite, metal, metal alloy, wood, wood composite rubber and rubber composite.

15. The second tube lamp (210) as described in claim 8, wherein the second holder left clip (214L) comprises an outwardly angled second holder left clip flair (214LA), the second holder right clip (214R) further comprises an outwardly angled second holder right clip flair (214RA), the second holder left clip flair (214LA) and the second holder right clip flair (214RA) function to facilitate positioning the second holder adaptor (214A) within the second holder cavity (214C).

16. A third tube lamp (310) comprising:

A) a third holder front adaptor (314F) which comprises a third holder front adaptor right reflector (314FR) and a third holder front adaptor left reflector (314FL) forming a third holder front adaptor cavity (314FC) therebetween removably engaging a tube light (12) therein, third holder front adaptor (314F) comprises a third holder front adaptor base (314FB) functioning as a stable mount to attach to a surface;

B) a third holder rear adaptor (314R) which comprises a third holder rear adaptor right reflector (314RR) and a third holder rear adaptor left reflector (314RL) forming a third holder rear adaptor cavity (314RC) therebetween removably engaging the tube light (12) therein, third holder rear adaptor (314R) comprises a third holder rear adaptor base (314RB) functioning as a stable mount to attach to a surface; and C) a third holder middle adaptor (314C) which comprises a third holder middle adaptor right reflector (314CR) and a third holder middle adaptor left reflector (314CL) forming a third holder middle adaptor cavity (314CC) therebetween rotatably engaging the tube light (12) therein.

17. The third tube lamp (310) as described in claim 16, wherein the third holder front adaptor (314F) and the third holder rear adaptor (314R) and the third holder middle (314C) are manufactured from a material selected from a group consisting of plastic, plastic composite, glass, glass composite, rubber, rubber composite, metal, metal alloy, wood, and wood composite.

18. The third tube lamp (310) as described in claim 16, wherein the third holder front adaptor cavity (314FC) and the third holder rear adaptor cavity (314RC) are closed comprising a covering thereover.

* * * * *